US007049278B2

(12) United States Patent
Hage et al.

(10) Patent No.: US 7,049,278 B2
(45) Date of Patent: May 23, 2006

(54) COMPOSITION AND METHOD FOR BLEACHING A SUBSTRATE

(75) Inventors: Ronald Hage, Vlaardingen (NL); Ton Swarthoff, Vlaardingen (NL); David Tetard, Wirral (GB); David William Thornthwaite, Wirral (GB)

(73) Assignee: Unilever Home and Personal Care USA Division of Conopco, Inc., Greenwich, CT (US)

( * ) Notice: Subject to any disclaimer, the term of this patent is extended or adjusted under 35 U.S.C. 154(b) by 374 days.

(21) Appl. No.: 10/645,657

(22) Filed: Aug. 22, 2003

(65) Prior Publication Data

US 2004/0038844 A1 Feb. 26, 2004

Related U.S. Application Data

(62) Division of application No. 09/796,210, filed on Feb. 28, 2001, now Pat. No. 6,638,901.

(30) Foreign Application Priority Data

Mar. 1, 2000 (GB) ..... 000004988

(51) Int. Cl.
*C11D 3/395* (2006.01)
*C11D 7/54* (2006.01)

(52) U.S. Cl. ..... 510/375; 510/302; 510/438

(58) Field of Classification Search ..... 510/375, 510/302, 438
See application file for complete search history.

(56) References Cited

U.S. PATENT DOCUMENTS

| | | | | |
|---|---|---|---|---|
| 4,087,369 | A | | 5/1978 | Wevers |
| 4,126,573 | A | | 11/1978 | Johnston |
| 4,391,723 | A | | 7/1983 | Bacon et al. |
| 4,399,049 | A | | 8/1983 | Gray et al. |
| 4,486,327 | A | | 12/1984 | Murphy et al. |
| 4,626,373 | A | | 12/1986 | Finch et al. |
| 4,681,695 | A | | 7/1987 | Divo |
| 4,728,455 | A | | 3/1988 | Rerek |
| 4,756,798 | A | | 7/1988 | Lachenal et al. |
| 4,786,431 | A | * | 11/1988 | Broze et al. ..... 510/304 |
| 5,747,438 | A | | 5/1998 | MacBeath |
| 5,747,441 | A | | 5/1998 | Domburg et al. |
| 5,755,992 | A | | 5/1998 | Jeffrey et al. |
| 5,965,505 | A | | 10/1999 | Baillely et al. |
| 6,022,490 | A | | 2/2000 | Hermant et al. |

FOREIGN PATENT DOCUMENTS

| | | |
|---|---|---|
| DE | 197 21 886 | 12/1998 |
| DE | 199 09 546 | 6/2000 |
| EP | 0 436 062 | 7/1991 |
| WO | 95/28464 | 10/1995 |
| WO | 95/34628 | 12/1995 |
| WO | 97/38074 | 10/1997 |
| WO | 97/48787 | 12/1997 |
| WO | 00/12667 | 3/2000 |
| WO | 00/12808 | 3/2000 |
| WO | 00/47812 | 8/2000 |
| WO | 00/60044 | 10/2000 |
| WO | 01/16270 | 3/2001 |

* cited by examiner

*Primary Examiner*—Yogendra N. Gupta
*Assistant Examiner*—John M Petruncio
(74) *Attorney, Agent, or Firm*—Rimma Mitelman

(57) ABSTRACT

The invention relates to catalytically bleaching substrates, especially laundry fabrics, with atmospheric oxygen and a peroxyl species. A method of bleaching a substrate is provided that comprises applying to the substrate, in an aqueous medium, a specified organic substance which forms a complex with a transition metal, the complex catalysing bleaching of the substrate by atmospheric oxygen and a peroxyl species. Also provided is a bleaching composition comprising, in an aqueous medium, atmospheric oxygen and an organic substance which forms a complex with a transition metal, the complex catalysing bleaching of the substrate by the atmospheric oxygen, wherein the aqueous medium is provided with a peroxygen bleach or a peroxy-based or peroxy-generating bleach system.

4 Claims, No Drawings

COMPOSITION AND METHOD FOR BLEACHING A SUBSTRATE

This is a divisional of Ser. No. 09/796,210 filed Feb. 28, 2001 now U.S. Pat. No. 6,638,901.

FIELD OF INVENTION

This invention relates to compositions and methods for catalytically bleaching substrates with atmospheric oxygen and a peroxyl species, using a metal-ligand complex as catalyst.

BACKGROUND OF INVENTION

Peroxygen bleaches are well known for their ability to remove stains from substrates. Traditionally, the substrate is subjected to hydrogen peroxide, or to substances which can generate peroxyl radicals, such as inorganic or organic peroxides. Generally, these systems must be activated. One method of activation is to employ wash temperatures of 60° C. or higher. However, these high temperatures often lead to inefficient cleaning, and can also cause premature damage to the substrate.

A preferred approach to generating peroxyl bleach species is the use of inorganic peroxides coupled with organic precursor compounds. These systems are employed for many commercial laundry powders. For example, various European systems are based on tetraacetyl ethylenediamine (TAED) as the organic precursor coupled with sodium perborate or sodium percarbonate, whereas in the United States laundry bleach products are typically based on sodium nonanoyloxybenzenesulphonate (SNOBS) as the organic precursor coupled with sodium perborate.

Precursor systems are generally effective but still exhibit several disadvantages. For example, organic precursors are moderately sophisticated molecules requiring multi-step manufacturing processes resulting in high capital costs. Also, precursor systems have large formulation space requirements so that a significant proportion of a laundry powder must be devoted to the bleach components, leaving less room for other active ingredients and complicating the development of concentrated powders. Moreover, precursor systems do not bleach very efficiently in countries where consumers have wash habits entailing low dosage, short wash times, cold temperatures and low wash liquor to substrate ratios.

Alternatively, or additionally, hydrogen peroxide and peroxy systems can be activated by bleach catalysts, such as by complexes of iron and the ligand MeN4Py (i.e. N,N-bis (pyridin-2-yl-methyl)-bis(pyridin-2-yl)methylamine) disclosed in WO95/34628, or the ligand Tpen (i.e. N,N,N',N'-tetra(pyridin-2-yl-methyl)ethylenediamine) disclosed in WO97/48787.

As discussed by N. J. Milne in J. of Surfactants and Detergents, Vol 1, no 2, 253–261 (1998), it has long been thought desirable to be able to use atmospheric oxygen (air) as the source for a bleaching species. The use of atmospheric oxygen (air) as the source for a bleaching species would avoid the need for costly peroxyl generating systems. Unfortunately, air as such is kinetically inert towards bleaching substrates and exhibits no bleaching ability. Recently some progress has been made in this area. For example, WO 97/38074 reports the use of air for oxidising stains on fabrics by bubbling air through an aqueous solution containing an aldehyde and a radical initiator. A broad range of aliphatic, aromatic and heterocyclic aldehydes is reported to be useful, particularly para-substituted aldehydes such as 4-methyl-, 4-ethyl- and 4-isopropyl benzaldehyde, whereas the range of initiators disclosed includes N-hydroxysuccinimide, various peroxides and transition metal coordination complexes.

However, although this system employs molecular oxygen from the air, the aldehyde component and radical initiators such as peroxides are consumed during the bleaching process. These components must therefore be included in the composition in relatively high amounts so as not to become depleted before completion of the bleaching process in the wash cycle. Moreover, the spent components represent a waste of resources as they can no longer participate in the bleaching process.

The recent development of air bleaching using O2 bleaching catalysts has provided an effective bleach composition that does not rely on peroxygen bleach or a peroxy-based or peroxyl-generating bleach system. One significant advantage of these recent developments is that the oxygen in the air is provided free.

Presently, oxygen bleaching catalysts per se are more selective in bleaching oily stains, for example tomato stains than polar stains, for example tea. It would be advantageous to provide an air bleaching composition that is effective on both oily and polar stains. In addition, it would be advantageous to provide a bleaching composition that contains a reduced amount of peroxyl or peroxyl generating system per wash dose.

SUMMARY OF INVENTION

We have now found that it is possible to achieve a bleaching composition that has a broad stain bleaching ability, for example, bleaching of both oily tomato and tea type stains.

Catalysts of the present invention catalyse bleaching of stains with either oxygen or peroxy species. An object of the present invention is to provide a bleaching composition that allows bleaching in a single wash with both oxygen and a hydroperoxy species in the presence of a catalyst, i.e., dual bleaching. The dual bleaching is achieved by an aqueous solution of a bleaching composition in which oxygen competes with a peroxyl species for interaction with an oxygen bleaching catalyst. The concentration of peroxyl species that is provided by a unit dose allows oxygen bleaching to compete in an aqueous wash.

When a peroxyl species is present in a dominant concentration in an aqueous solution of an oxygen bleaching catalyst the reaction of oxygen with the oxygen bleaching catalyst is suppressed. One factor that is difficult to change in an aqueous solution is the low solubility of oxygen in water. The concentration of oxygen in water is relatively low when compared to organic solvents. The oxygen concentration in water is approximately 0.2 mM at 20° C. and the solubility of oxygen in water decreases about 15% per 10° C. increase in temperature of the water as detailed in The Handbook of Chemistry and Physics, $72^{nd}$ Edition, CRC press. Hence, the oxygen concentration in water at 40° C. is approximately 0.15 mM. In order, for oxygen in an aqueous solution to compete with a peroxyl species, the concentration of the peroxyl species has to be substantially below conventional concentrations of between 5 and 10 mM that are found in aqueous wash mixtures. Throughout the disclosure and claims the description of oxygen concentration refers to the concentration of oxygen dissolved in an aqueous environment unless otherwise specified.

Alternatively, dual bleaching is achieved in a stepwise fashion by changing from oxygen bleaching to hydroperoxy bleaching during the course of an aqueous wash. The stepwise bleaching may be achieved in the following manner. 1) Initially bleaching with oxygen followed by raising the concentration of a peroxyl species present. 2) Reducing the concentration of peroxyl species in the wash such that oxygen bleaching is effective.

In contrast to having a limited amount of a hydroperoxy species present in a wash the bleaching composition may contain an agent for decomposing hydrogen peroxide during a wash cycle. Initially during a wash hydrogen peroxide acts as the main bleaching agent in conjunction with a catalyst but as the wash proceeds a hydrogen peroxide decomposing agent is released into the wash. The hydrogen peroxide decomposing agent decomposes hydrogen peroxide into water and oxygen thereby reducing the hydrogen peroxide concentration in the wash. A consequence of reducing the hydrogen peroxide concentration in the wash is that oxygen dissolved in the wash can compete for the catalyst. It is most likely that amounts of the oxygen generated from decomposition of hydrogen peroxide will end up in solution in the wash and participate in the oxygen catalysed bleaching process. A particular benefit of generating hydrogen peroxide in solution is that some gasses other than oxygen in solution, for example nitrogen, will be displaced by the oxygen generated in situ. A beneficial consequence is that the oxygen concentration in an aqueous wash mixture may well exceed 0.2 mM. Oxygen makes up approximately 20% of air and the maximum concentration of oxygen in water at standard temperature and pressure (STP) is about 1 mM. A concentration of oxygen above 0.2 mM would serve to facilitate oxygen bleaching. The catalase enzyme/catalase enzyme mimics provide a suitable class of enzymes for decomposing hydrogen peroxide.

The present invention provides an oxygen-peroxyl competing bleaching composition for use in an aqueous wash medium for bleaching a substrate, the oxygen-peroxyl competing bleaching composition comprising:

(i) an organic substance which forms a complex with a transition metal, the complex for catalysing bleaching of the substrate by atmospheric oxygen in the aqueous medium; and, (ii) a peroxyl bleaching agent selected from the group consisting of: a peroxyl species and a peroxyl species precursor, for bleaching the substrate in the aqueous medium, wherein application of a unit dose of the oxygen-peroxyl competing bleaching composition to an aqueous medium provides a concentration of peroxyl species that permits dual bleaching during a wash.

The peroxy species may further be activated by the complex or react with a peroxy acid precursor to yield a peroxy acid.

The present invention extends to a method of bleaching a substrate in an aqueous solution during a wash which comprises the steps of:

providing a concentration of a peroxyl species in the aqueous solution for bleaching tea type stains optionally with a transition metal catalyst that further activates the hydrogen peroxide and/or optionally with a peroxy acid precursor to yield a peroxy acid;

providing an amount of oxygen bleaching catalyst to the wash together with oxygen dissolved in the aqueous solution;

reducing the concentration of peroxyl species in the aqueous solution for increasing the amount of oxygen bleaching catalyst available for oxygen bleaching.

In this method oxygen competes with a peroxyl species that is released into an aqueous medium over the course of a wash. In the beginning of a laundry wash the dominant bleaching effect is from oxygen bleaching but as the wash proceeds the concentration of a peroxyl species increases. The increase in peroxygen species suppresses and eventually predominates over oxygen bleaching. It is preferred that the wash is at a temperature of between 10° C. and 45° C., most preferably between 20° C. and 40° C.

In this method it is preferred that in the aqueous medium the [oxygen species-complex]/[peroxyl species-complex] is between 10 and 0.1 at a point in time during the wash.

As one skilled in the art will appreciate catalytic mechanisms are complicated. In a particular transformation there may be more than a single pathway or mechanism involved. Presently it is not certain if the "oxygen catalysts" function by forming an oxygen species-complex/peroxyl species-complex or activate the stain such that activated stain reacts with oxygen/peroxyl. To avoid an overly pedantic analysis of particular concentrations of species the following is provided. In the disclosure and claims the term [peroxyl species-complex] indicates a concentration. The mechanism of bleaching a stain with peroxyl and the complex is not well understood; it is likely that peroxy activation and/or stain activation is taking place. It is possible that this complex forms an active species with peroxyl and that this active peroxyl species-complex bleaches the stain. Alternatively, it is possible that the complex activates a stain such that the activated stain reacts with the peroxyl. In light of the above, one skilled in the art will appreciate that the term [peroxyl species-complex] reflects the concentration of peroxyl used in of the action of the complex in a wash at any given time. The term [peroxyl species-complex] should be construed as such.

In the disclosure and claims the term [oxygen species-complex] indicates a concentration. The mechanism of bleaching a stain with oxygen and the complex is not well understood; it is likely that it is possible that oxygen activation and/or stain activation is taking place. It is possible that this complex forms an active species with oxygen and that this active oxygen species-complex bleaches the stain. Alternatively, it is possible that the complex activates a stain such that the activated stain reacts with the oxygen. In light of the above, one skilled in the art will appreciate that the term [oxygen species-complex] reflects the concentration of oxygen used in of the action of the complex in a wash at any given time. The term [oxygen species-complex] should be construed as such.

Consideration of the [oxygen species-complex]/[peroxyl species-complex] is important because the ratio of the rate of depletion of oxygen and a particular peroxy species may vary for a particular catalyst. Nevertheless, it is possible that the rate of depletion of oxygen and a particular peroxy species may not vary significantly for most oxygen bleaching catalysts. In this regard, the ratio $[O_2]$/[total active peroxyl species present] in a wash is useful in defining the invention. The [total active peroxyl species present] represents the concentration of peroxyl species present in solution that is available for bleaching in contrast to a concentration of a peroxyl precursor which is not immediately available for bleaching. As one skilled in the art will appreciate washes are usually conducted in a basic aqueous environment at a pH of approximately 10. Hence, when only hydrogen peroxide is present as a peroxyl bleaching species [total peroxyl present]=$[H_2O_2]$+$[HOO^-]$. In a similar manner, when only a peroxyacid is present as a peroxyl bleaching species [total peroxyl present)=[RC(O)OOH]+[RC(O)

$OO^-$]. When a mixture of hydrogen peroxide and peroxyacid are present [total peroxyl present]=[RC(O)OOH]+[RC(O)$OO^-$]+[$H_2O_2$]+[$HOO^-$]. It is preferred that: [$O_2$]/[total peroxyl present] is in the range 10 and 0.1, which is indicative of a (total peroxyl present] of approximately between 2 mM and 0.02 mM.

The present invention provides differing scenarios for dual bleaching in the presence of an oxygen bleaching catalyst.

1. In a wash, initially approximately 0.2 mM $O_2$ is present and then a peroxyl species is provided in solution such that the peroxyl species dominates the bleaching activity of the wash, for example between 5 and 10 mM peroxyl species.
2. In a wash, initially between 5 to 10 mM hydrogen peroxide is present with approximately 0.2 mM oxygen after which a catalase or a catalase mimic is provided that decomposes the hydrogen peroxide present. The oxygen provided by the decomposed hydrogen peroxide participates on the oxygen bleaching in conjunction with atmospheric oxygen.
3. In a wash, both a peroxyl species and oxygen are initially present in competing concentrations.

In addition to the teachings above the use of a drying step, most preferably in a heated agitated environment as for example found in a tumble dryer has also been found to accelerate and enhance the air bleaching effect. The enhancement may be provided with or without competing amounts of a peroxyl species present.

DETAILED DESCRIPTION OF THE INVENTION

The organic substance may comprise a preformed complex of a ligand and a transition metal. Alternatively, the organic substance may comprise a free ligand that complexes with a transition metal already present in the bleaching liquid, treatment medium or wash water or that complexes with a transition metal present in the substrate. The organic substance may also be included in the form of a composition of a free ligand or a transition metal-substitutable metal-ligand complex, and a source of transition metal, whereby the complex is formed in situ in the bleaching liquid, treatment medium or wash water.

The concentration of peroxyl species to provide the dual bleaching in an aqueous wash is dependent upon the rates of consumption of both peroxyl species and oxygen in the wash. By determining both rates a suitable dual bleaching composition may be designed.

In a conventional wash containing a hydroperoxyl the concentrations of hydroperoxyl species in a wash is present between 5 and 10 mM. It is preferred that peroxyl species present in a wash is below 0.5 mM, preferably below 0.1 mM.

A unit dose as used herein is a particular amount of the bleaching composition used for a type of wash. The unit dose may be in the form of a defined volume of powder, granules or tablet.

As one skilled in the art will appreciate there are numerous suitable peroxy species that will have an enhanced bleaching activity in the presence of a complex. Suitable peroxy species are found in the following general classes of compounds: peroxyacids; peroxides, peroxysulfates, peroxyphosphates, etc.

The peroxy compound bleaches that can be utilised in the present invention include hydrogen peroxide, hydrogen peroxide-liberating compounds, hydrogen peroxide-generating systems, peroxy acids and their salts and peroxy acid bleach percursor system, monoperoxysulphate salts, peroxyphosphate salt and mixtures thereof. Hydrogen peroxide sources are well known in the art. They include alkali metal peroxides, organic peroxidase bleaching compounds such as urea peroxide, and inorganic persalt bleaching compounds, such as the alkali metal perborates, percarbonates, peroxyphosphates, and peroxysulphates. Mixtures of two or more of such compounds may also be suitable. Particularly preferred are sodium perborate or sodium percarbonate. These bleaching compounds may further be employed in conjunction with a peroxyacid bleaching precursor, for example tetraacetylethylenediamine (TAED) or sodium nonanoyloxybenzenesulphonate (SNOBS). The use of a peroxyacid bleaching precursor as detailed above for bleaching a substrate will likely reduce the presence of bacteria on washed laundry, improve bleaching performance and in the case of white fabric increase the overall whiteness appearance of the white fabric.

Peroxyacid bleaches and their precursors are known and amply described in literature. Suitable examples of this general class include magnesium monoperoxyphthalate hexahydrate (INTEROX), metachloro perbenzoic acid, 4-nonylamino-4oxoperoxybutyric acid and diperoxydodecanedioic acid, 6-nonylamino-6-oxoperoxycaproic acid (NAPAA), peroxybenzoic acid, ring-substituted peroxybenzoic acids, e.g., peroxy-o-naphthoic acid, peroxylauric acid, peroxystearic acid, 1,9-diperoxyazelaic acid, 1,12-diperoxydodecanedioc acid, diperoxybrassylic acid, diperoxysebacic acid, diperoxyisophthalic acid, 2-decyldiperoxybutane-1,4-dioic acid, 4,4'-sulfonybisperoxybenzoic acid, and N,N-phthaloylaminoperoxycaproic acid (PAP). nonanoyloxybenzenesulphonate (SNOBS). Other examples of peroxyacid bleaches and their precursors are described in Chemistry & Industry (15 Oct. 1990), 647–653, an article by Grime and Clauss.

It is also possible to generate a peracid in situ whilst oxygen bleaching, WO 97/38074 reports the use of air for oxidising stains on fabrics by bubbling air through an aqueous solution containing an aldehyde and a radical initiator. It is likely that an acyl radical is formed that reacts with oxygen to produce an acylperoxy radical; the acyl peroxy radical subsequently abstracts a hydrogen to form a peracid. An aqueous solution containing oxygen, an aldehyde, a radical initiator, and an oxygen bleaching catalyst would likely result in duel bleaching.

Hydrogen peroxide may be generated in situ by using various enzymes, see WO-A-9507972. An example of a hydrogen peroxide producing enzyme is glucose oxidase. Glucose oxidase requires the presence of glucose to generate hydrogen peroxide. The glucose may be added to the bleaching composition or generated in situ with, for example, amylase that produces glucose from starch. The glucose oxidase may be present in a unit dose of the bleaching composition such that in the wash solution glucose oxidase is present at a concentration of 100 μg/l to 0.5 g/l together with 0.1 to 15% glucose, preferably 0.5% glucose. The glucose in the bleaching composition may be also generated in situ with for example amylase that produces glucose from starch, for further discussion the reader is directed to T. S. Rasmussen et al. in J. Sci. Food Agric., 52(2), 159–70 (1990).

If amylase is used for the generation of glucose it is preferred that starch is present in the wash at 0.1% concentration. Other examples of oxidases include, an amine oxidase and an amine, an amino acid oxidase and an amino acid, cholesterol oxidase and cholesterol, uric acid oxidase and uric acid or a xanthine oxidase with xanthine as found in WO9856885. A preferred hydrogen peroxide generating system is a C1–C4-alkanol oxidase in conjunction with a C1–C4-alkanol. A most preferred hydrogen peroxide generating system is the combination of methanol oxidase and ethanol. The methanol oxidase is preferably isolated from a catalase-negative *Hansenula polymorpha* strain, see for example EP-A-244 920. The preferred oxidases are glucose oxidase, galactose oxidase and alcohol oxidase.

Alternatively, hydrogen peroxide may be generated by a co-reductant in situ. The co-reductant is present in a concentration in the wash between 0.1 and 1000 μM, more preferably between 1 μM and 500 μM and most preferably between 10 μM and 100 μM. Without being bound to theory, it is known that upon reduction of dioxygen by a reductant, which may be accelerated by any transition metal catalyst disclosed in the patent, active species like superoxide and/or hydrogen peroxide may be formed. Thus, instead of using the aforementioned oxidase enzymes, one uses other reductants and optionally a catalyst to form the desired hydrogen peroxide. Suitable reductants may be selected from: Borohydrides (such as NaBH4), Hydroxylamines (RO—NR2 where R are independently H, alkyl, benzyl), Hydrazines (R—NH—NR2 where R are independently H, alkyl, benzyl), pure metals (such as Zn; optionally in combination with methylviologen), dithionites, formates, sulfur, thiol-containing compounds, sulfites, hydroquinones, phthalimides, ascrobic acid/ascorbates, 1,5-dihydroflavines, pyrroloquinolinequinone (PQQ), dialuric acid, bis(3,5-dimethyl-5-hydroxymethyl-2-oxomorpholin-3-yl).

The generation of hydrogen peroxide in situ is advantageous in that a steady state of hydrogen peroxide is produced. Oxygen may effectively compete as a bleaching precursor by tailoring the in situ hydrogen peroxide producing system. The system may be tailored such that hydrogen peroxide is kept at a level much lower that found in a conventional hydrogen peroxide bleaching wash or that precursors for the in situ hydrogen peroxide producing system are depleted during the wash.

Alternatively, the concentration of hydrogen peroxide in an aqueous wash may be reduced so that oxygen bleaching effectively competes. In this regard, catalase or catalase enzyme mimics may be used. Catalase enzyme mimics are well known in the art, for example transition-metal complexes that decompose hydrogen peroxide into dioxygen and water, i.e., catalase enzyme mimics, have been discussed in various papers. In particular, dinuclear manganese(II) and manganese(III) complexes have been studied towards their catalase activity, as reviewed in a number of recent papers, see for example R. Hage, Oxidation Catalysis by Biomimetic Manganese Complexes, Recl. Trav. Chim. Pays-Bas, 115, 385–395 (1996) and N. A. Law et al. in Manganese redox enzymes and model systems: Properties, structures, and reactivity Adv Inorg. Chem., 46, 305–440 (1999).

The present invention encompasses the time release of certain substances during a wash. The time release generally requires the use of a release agent. The release agent is an agent that releases a substance into the wash environment in a controlled manner. The substance is a bleaching species or source thereof or an enzyme as described herein. For granular and powder cleaning products, the substance can be contained in the form of a granulate. The granulate may suitably further contain various granulation aids, binders, fillers, plasticisers, lubricants, cores and the like. Examples of the granulation aids include: cellulose, for example cellulose in fibre or microcrystalline form; dextrins, for example yellow dextrin; polyvinylpyrrolidone; polyvinylalcohol; cellulose derivatives such as CIVIC, MC, HPC or HPMC; gelatin; starch sugar; salts, for example sodium sulphate, sodium chloride, calcium sulphate or calcium carbonate; titanium dioxide; talc and clays, for example kaolin, montmorilonite or bentonite; Other materials of relevance for incorporation in the granulates of the type in question are described, for example, in EP 0 304 331 BI, and will be well known to persons skilled in the art.

The release agent may be, for example, a coating. The coating protects the granulates/co-granulates in the wash environment for a certain period of time. The coating will normally be applied to the granulates/co-granulates in an amount in the range of 1% to 50% by weight (calculated on the basis of the weight of the uncoated, dry granulate), preferably in the range of 5% to 40% by weight. The amount of coating to be applied to the granulates will depend to a considerable extent on the nature and composition of the desired coating, and to the kind of protection the coating should offer to the granulates. For example, the thickness of the coating or a multi-layered coating applied onto any of the above granulates may determine the period in which the content of the granulates is released. A possible multi-layered coating may be a coating in which a fast release coating is coated over a slow release coating.

Preferred release coating are coatings that are substantially insoluble in water. Release coatings that are appropriate in washing media may suitably comprise substances selected from the following: tallow; hydrogenated tallow; partially hydrolyzed tallow; fatty acids and fatty alcohols of natural and synthetic origin; long-chain fatty acid mono-, di- and triesters of glycerol, for example glycerol monostearate; ethoxylated fatty alcohols; latexes; hydrocarbons of melting point in the range of 40–80° C.; and waxes. Melt-coating agents are a preferred class of fast or slow release coating agents that can be used without dilution with water. Reference may be made to Controlled Release Systems: Fabrication Technology, Vol. 1, CRC Press, 1988, for further information on slow release coating.

Coatings may suitably further comprise substances such as clays, for example kaolin, titanium dioxide, pigments, salts, for example calcium carbonate and the like. The person skilled in the art will be aware of further coating constituents of relevance in the present invention.

In a liquid cleaning compositions of the present invention, the substance may be incorporated as a dispersion of particles further containing a release agent. The substance can be present in a liquid or solid form. Suitable particles consist of a porous hydrophobic material, for example silica with an average pore diameter of 500 Angstrom or higher as described in EP 583 512.

The release agent might be a coating that protects the particles in the wash cycle for a certain period of time. The coating is preferably a hydrophobic material such as hydrophobic liquid polymer. The polymer can be an organo polysiloxane oil, alternatively a high molecular weight hydrocarbon or water-insoluble but water-permeable polymeric material such as CIVIC, PVA or PVP. The polymer properties are selected to achieve suitable release profile of the source of peroxide in the wash solution.

Many transition metal complexes have high extinction coefficients in the visible. In this regard, use over time may result in some colour deposition on a substrate after repeated washing. The addition of a limited amount of a peroxyl source serves to reduce colour deposition in those instances in which it occurs whilst still permitting air bleaching.

The concept of bleaching with a dual mode of action has been disclosed. After selecting a catalyst, or mixtures of catalysts, it is a matter of determining the rates of consumption of both oxygen and a selected peroxyl species with the selected catalyst(s). It is then a matter of routine experimentation to formulate a bleaching composition that both bleaches with oxygen and a peroxyl species during a wash.

The following are examples of suitable oxygen bleaching catalysts that may be used in the present invention. The oxygen catalyst may comprise a preformed complex of a ligand and a transition metal. Alternatively, the catalyst may comprise a free ligand that complexes with a transition metal already present in the water or that complexes with a transition metal present in the substrate. The catalyst may also be included in the form of a composition of a free ligand or a transition metal-substitutable metal-ligand complex, and a source of transition metal, whereby the complex is formed in situ in the medium.

The ligand forms a complex with one or more transition metals, in the latter case for example as a dinuclear complex. Suitable transition metals include for example: manganese in oxidation states II–V, iron II–V, copper I–III, cobalt I–III, titanium II–IV, tungsten IV–VI, vanadium II–V and molybdenum II–VI.

The transition metal complex preferably is of the general formula:

$$[M_aL_kX_n]Y_m$$

in which:

M represents a metal selected from Mn(II)–(III)–(IV)–(V), Cu(I)–(II)–(III), Fe (II)–(III)–(IV)–(V), Co(I)–(II)–(III), Ti(II)–(III)–(IV), V(II)–(III)–(IV)–(V), Mo(II)–(III)–(IV)–(V)–(VI) and W(IV)–(V)–(VI), preferably from Fe(II)–(III)–(IV)–(V);

L represents the ligand, preferably N,N-bis(pyridin-2-yl-methyl)-1,1-bis(pyridin-2-yl)-1-aminoethane, or its protonated or deprotonated analogue;

X represents a coordinating species selected from any mono, bi or tri charged anions and any neutral molecules able to coordinate the metal in a mono, bi or tridentate manner;

Y represents any non-coordinated counter ion;

a represents an integer from 1 to 10;

k represents an integer from 1 to 10;

n represents zero or an integer from 1 to 10;

m represents zero or an integer from 1 to 20.

Preferably, the complex is an iron complex comprising the ligand N,N-bis(pyridin-2-yl-methyl)-1,1-bis(pyridin-2-yl)-1-aminoethane. However, it will be appreciated that the pretreatment method of the present invention may instead, or additionally, use other ligands and transition metal complexes, provided that the complex formed is capable of catalysing stain bleaching by atmospheric oxygen. Suitable classes of ligands are described below:

(A) Ligands of the General Formula (IA):

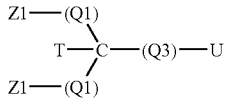

(IA)

wherein

Z1 groups independently represent a coordinating group selected from hydroxy, amino, —NHR or —$N(R)_2$ (wherein R=$C_{1-6}$-alkyl), carboxylate, amido, —NH—$C(NH)NH_2$, hydroxyphenyl, a heterocyclic ring optionally substituted by one or more functional groups E or a heteroaromatic ring optionally substituted by one or more functional groups E, the heteroaromatic ring being selected from pyridine, pyrimidine, pyrazine, pyrazole, imidazole, benzimidazole, quinoline, quinoxaline, triazole, isoquinoline, carbazole, indole, isoindole, oxazole and thiazole;

Q1 and Q3 independently represent a group of the formula:

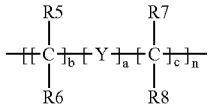

wherein

5≧a+b+c≧1; a=0–5; b=0–5; c=0–5; n=0 or 1 (preferably n=0);

Y independently represents a group selected from —O—, —S—, —SO—, —$SO_2$—, —C(O)—, arylene, alkylene, heteroarylene, heterocycloalkylene, -(G)P—, —P(O)— and -(G)N—, wherein G is selected from hydrogen, alkyl, aryl, arylalkyl, cycloalkyl, each except hydrogen being optionally substituted by one or more functional groups E;

R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I;

T represents a non-coordinated group selected from hydrogen, hydroxyl, halogen, —R and —OR, wherein R represents alkyl, alkenyl, cycloalkyl, heterocycloalkyl, aryl, arylalkyl, heteroaryl or a carbonyl derivative group, R being optionally substituted by one or more functional groups E (preferably T=—H, —OH, methyl, methoxy or benzyl);

U represents either a non-coordinated group T independently defined as above or a coordinating group of the general formula (IIA), (IIIA) or (IVA):

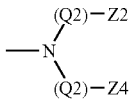

(IIA)

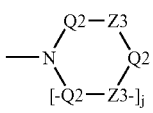

(IIIA)

-continued (IVA)

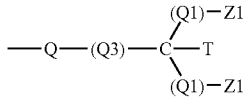

wherein

Q2 and Q4 are independently defined as for Q1 and Q3;

Q represents —N(T)- (wherein T is independently defined as above), or an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

Z2 is independently defined as for Z1;

Z3 groups independently represent —N(T)- (wherein T is independently defined as above);

Z4 represents a coordinating or non-coordinating group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E, or Z4 represents a group of the general formula (IIAa):

(IIAa)

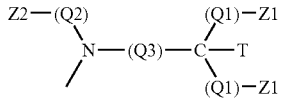

and $1 \leqq j < 4$.

Preferably, Z1, Z2 and Z4 independently represent an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole. More preferably, Z1, Z2 and Z4 independently represent groups selected from optionally substituted pyridin-2-yl, optionally substituted imidazol-2-yl, optionally substituted imidazol-4-yl, optionally substituted pyrazol-1-yl, and optionally substituted quinolin-2-yl. Most preferred is that Z1, Z2 and Z4 each represent optionally substituted pyridin-2-yl.

The groups Z1, Z2 and Z4 if substituted, are preferably substituted by a group selected from $C_{1-4}$-alkyl, aryl, arylalkyl, heteroaryl, methoxy, hydroxy, nitro, amino, carboxyl, halo, and carbonyl. Preferred is that Z1, Z2 and Z4 are each substituted by a methyl group. Also, we prefer that the Z1 groups represent identical groups.

Each Q1 preferably represents a covalent bond or C1–C4-alkylene, more preferably a covalent bond, methylene or ethylene, most preferably a covalent bond.

Group Q preferably represents a covalent bond or C1–C4-alkylene, more preferably a covalent bond.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

Non-coordinated group T preferably represents hydrogen, hydroxy, methyl, ethyl, benzyl, or methoxy.

In one aspect, the group U in formula (IA) represents a coordinating group of the general formula (IIA):

(IIA)

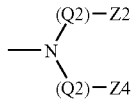

According to this aspect, it is preferred that Z2 represents an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole, more preferably optionally substituted pyridin-2-yl or optionally substituted benzimidazol-2-yl.

It is also preferred, in this aspect, that Z4 represents an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole, more preferably optionally substituted pyridin-2-yl, or an non-coordinating group selected from hydrogen, hydroxy, alkoxy, alkyl, alkenyl, cycloalkyl, aryl, or benzyl.

In preferred embodiments of this aspect, the ligand is selected from:

1,1-bis(pyridin-2-yl)-N-methyl-N-(pyridin-2-ylmethyl) methylamine;

1,1-bis(pyridin-2-yl)-N,N-bis(6-methyl-pyridin-2-ylmethyl)methylamine;

1,1-bis(pyridin-2-yl)-N,N-bis(5-carboxymethyl-pyridin-2-ylmethyl)methylamine;

1,1-bis(pyridin-2-yl)-1-benzyl-N,N-bis(pyridin-2-ylmethyl)methylamine; and 1,1-bis(pyridin-2yl)-N,N-bis(benzimidazol-2-ylmethyl) methylamine.

In a variant of this aspect, the group Z4 in formula (IIA) represents a group of the general formula (IIAa):

(IIAa)

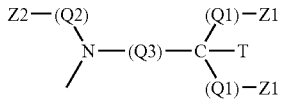

In this variant, Q4 preferably represents optionally substituted alkylene, preferably —$CH_2$—CHOH—$CH_2$— or —$CH_2$—$CH_2$—$CH_2$—. In a preferred embodiment of this variant, the ligand is:

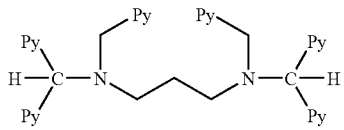

wherein -Py represents pyridin-2-yl.

In another aspect, the group U in formula (IA) represents a coordinating group of the general formula (IIIA):

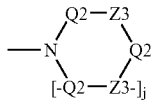

(IIIA)

wherein j is 1 or 2, preferably 1.

According to this aspect, each Q2 preferably represents —$(CH_2)_n$— (n=2–4), and each Z3 preferably represents —N(R)— wherein R=—H or $C_{1-4}$-alkyl, preferably methyl.

In preferred embodiments of this aspect, the ligand is selected from:

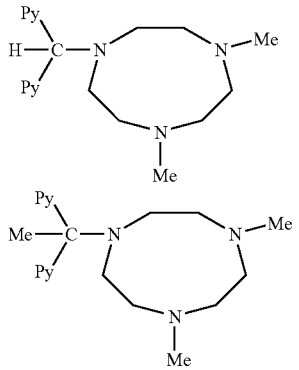

wherein -Py represents pyridin-2-yl.

In yet another aspect, the group U in formula (IA) represents a coordinating group of the general formula (IVA):

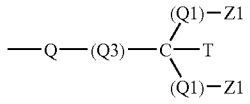

(IVA)

In this aspect, Q preferably represents —N(T)- (wherein T=—H, methyl, or benzyl) or pyridin-diyl.

In preferred embodiments of this aspect, the ligand is selected from:

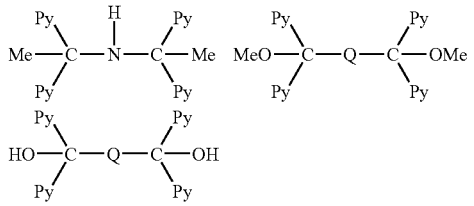

wherein -Py represents pyridin-2-yl, and -Q- represents pyridin-2,6-diyl.

(B) Ligands of the General Formula (IB):

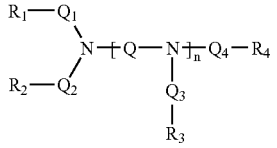

(IB)

wherein n=1 or 2, whereby if n=2, then each $-Q_3-R_3$ group is independently defined;

$R_1$, $R_2$, $R_3$, $R_4$ independently represent a group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E, $Q_1$, $Q_2$, $Q_3$, $Q_4$ and Q independently represent a group of the formula:

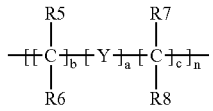

wherein

5≧a+b+c≧1; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, -(G)P—, —P(O)— and -(G)N—, wherein G is selected from hydrogen, alkyl, aryl, arylalkyl, cycloalkyl, each except hydrogen being optionally substituted by one or more functional groups E;

R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I, provided that at least two of $R_1$, $R_2$, $R_3$, $R_4$ comprise coordinating heteroatoms and no more than six heteroatoms are coordinated to the same transition metal atom.

At least two, and preferably at least three, of $R_1$, $R_2$, $R_3$, $R_4$ independently represent a group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

Preferably, substituents for groups $R_1$, $R_2$, $R_3$, $R_4$, when representing a heterocyclic or heteroaromatic ring, are selected from $C_{1-4}$-alkyl, aryl, arylalkyl, heteroaryl, methoxy, hydroxy, nitro, amino, carboxyl, halo, and carbonyl.

The groups $Q_1$, $Q_2$, $Q_3$, $Q_4$ preferably independently represent a group selected from —$CH_2$— and —$CH_2CH_2$—.

Group Q is preferably a group selected from —$(CH_2)_{2-4}$—, —$CH_2CH(OH)CH_2$—,

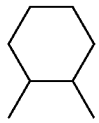

optionally substituted by methyl or ethyl,

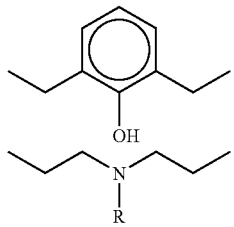

,

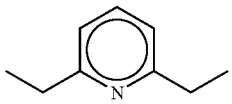

, and wherein R represents —H or $C_{1-4}$-alkyl.

Preferably, $Q_1$, $Q_2$, $Q_3$, $Q_4$ are defined such that a=b=0, c=1 and n=1, and Q is defined such that a=b=0, c=2 and n=1.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_{20}$-alkyl, carbonyl-$C_0$–$C_6$-alkoxy, and $C_0$–$C_{20}$-alkylamide. Preferably, none of R5–R8 is linked together.

In a preferred aspect, the ligand is of the general formula (IIB):

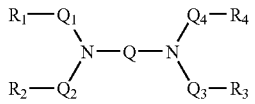

(IIB)

wherein $Q_1$, $Q_2$, $Q_3$, $Q_4$ are defined such that a=b=0, c=1 or 2 and n=1;

Q is defined such that a=b=0, c=2, 3 or 4 and n=1; and $R_1$, $R_2$, $R_3$, $R_4$, R7, R8 are independently defined as for formula (I).

Preferred classes of ligands according to this aspect, as represented by formula (IIB) above, are as follows:

(i) Ligands of the General Formula (IIB) Wherein:

$R_1$, $R_2$, $R_3$, $R_4$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

In this class, we prefer that:

Q is defined such that a=b=0, c=2 or 3 and n=1;

$R_1$, $R_2$, $R_3$, $R_4$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

(ii) Ligands of the General Formula (IIB) Wherein:

$R_1$, $R_2$, $R_3$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and $R_4$ represents a group selected from hydrogen, $C_{1-20}$ optionally substituted alkyl, $C_{1-20}$ optionally substituted arylalkyl, aryl, and $C_{1-20}$ optionally substituted-$NR_3^+$ (wherein R=$C_{1-8}$-alkyl).

In this class, we prefer that:

Q is defined such that a=b=0, c=2 or 3 and n=1;

$R_1$, $R_2$, $R_3$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and $R_4$ represents a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

(iii) Ligands of the General Formula (IIB) Wherein:

$R_1$, $R_4$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and $R_2$, $R_3$ each independently represent a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl).

In this class, we prefer that:

Q is defined such that a=b=0, c=2 or 3 and n=1;

$R_1$, $R_4$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and $R_2$, $R_3$ each independently represent a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

Examples of preferred ligands in their simplest forms are:

N,N',N'-tris(3-methyl-pyridin-2-ylmethyl)-ethylenediamine;

N-trimethylammoniumpropyl-N,N',N'-tris(pyridin-2-ylmethyl)-ethylenediamine;

N-(2-hydroxyethylene)-N,N',N'-tris(pyridin-2-ylmethyl)-ethylenediamine;

N,N,N',N'-tetrakis(3-methyl-pyridin-2-ylmethyl)-ethylenediamine;

N,N'-dimethyl-N,N'-bis(pyridin-2-ylmethyl)-cyclohexane-1,2-diamine;

N-(2-hydroxyethylene)-N,N',N'-tris(3-methyl-pyridin-2-ylmethyl)-ethylenediamine;

N-methyl-N,N',N'-tris(pyridin-2-ylmethyl)-ethylenediamine;

N-methyl-N,N',N'-tris(5-ethyl-pyridin-2-ylmethyl)-ethylenediamine;

N-methyl-N,N',N'-tris(5-methyl-pyridin-2-ylmethyl)-ethylenediamine;

N-methyl-N,N',N'-tris(3-methyl-pyridin-2-ylmethyl)-ethylenediamine;

N-benzyl-N,N',N'-tris(3-methyl-pyridin-2-ylmethyl)-ethylenediamine;

N-ethyl-N,N',N'-tris(3-methyl-pyridin-2-ylmethyl)-ethylenediamine;

N,N,N'-tris(3-methyl-pyridin-2-ylmethyl)-N'(2'-methoxyethyl-1)-ethylenediamine;

N,N,N'-tris(1-methyl-benzimidazol-2-yl)-N'-methyl-ethylenediamine;

N-(furan-2-yl)-N,N',N'-tris(3-methyl-pyridin-2-ylmethyl)-ethylenediamine;

N-(2-hydroxyethylene)-N,N',N'-tris(3-ethyl-pyridin-2-ylmethyl)-ethylenediamine;

N-methyl-N,N',N'-tris(3-methyl-pyridin-2-ylmethyl)ethylene-1,2-diamine;

N-ethyl-N,N',N'-tris(3-methyl-pyridin-2-ylmethyl)ethylene-1,2-diamine;

N-benzyl-N,N',N'-tris(3-methyl-pyridin-2-ylmethyl)ethylene-1,2-diamine;

N-(2-hydroxyethyl)-N,N',N'-tris(3-methyl-pyridin-2-ylmethyl)ethylene-1,2-diamine;

N-(2-methoxyethyl)-N,N',N'-tris(3-methyl-pyridin-2-ylmethyl)ethylene-1,2-diamine;

N-methyl-N,N',N'-tris(5-methyl-pyridin-2-ylmethyl)ethylene-1,2-diamine;

N-ethyl-N,N',N'-tris(5-methyl-pyridin-2-ylmethyl)ethylene-1,2-diamine;

N-benzyl-N,N',N'-tris(5-methyl-pyridin-2-ylmethyl)ethylene-1,2-diamine;

N-(2-hydroxyethyl)-N,N',N'-tris(5-methyl-pyridin-2-ylmethyl)ethylene-1,2-diamine;

N-(2-methoxyethyl)-N,N',N'-tris(5-methyl-pyridin-2-ylmethyl)ethylene-1,2-diamine;

N-methyl-N,N',N'-tris(3-ethyl-pyridin-2-ylmethyl)ethylene-1,2-diamine;

N-ethyl-N,N',N'-tris(3-ethyl-pyridin-2-ylmethyl)ethylene-1,2-diamine;

N-benzyl-N,N',N'-tris(3-ethyl-pyridin-2-ylmethyl)ethylene-1,2-diamine;

N-(2-hydroxyethyl)-N,N',N'-tris(3-ethyl-pyridin-2-ylmethyl)ethylene-1,2-diamine;

N-(2-methoxyethyl)-N,N',N'-tris(3-ethyl-pyridin-2-ylmethyl)ethylene-1,2-diamine;

N-methyl-N,N',N'-tris(5-ethyl-pyridin-2-ylmethyl)ethylene-1,2-diamine;

N-ethyl-N,N',N'-tris(5-ethyl-pyridin-2-ylmethyl)ethylene-1,2-diamine;

N-benzyl-N,N',N'-tris(5-ethyl-pyridin-2-ylmethyl)ethylene-1,2-diamine; and

N-(2-methoxyethyl)-N,N',N'-tris(5-ethyl-pyridin-2-ylmethyl)ethylene-1,2-diamine.

More preferred ligands are:

N-methyl-N,N',N'-tris(3-methyl-pyridin-2-ylmethyl)ethylene-1,2-diamine;

N-ethyl-N,N',N'-tris(3-methyl-pyridin-2-ylmethyl)ethylene-1,2-diamine;

N-benzyl-N,N',N'-tris(3-methyl-pyridin-2-ylmethyl)ethylene-1,2-diamine;

N-(2-hydroxyethyl)-N,N',N'-tris(3-methyl-pyridin-2-ylmethyl)ethylene-1,2-diamine; and N-(2-methoxyethyl)-N,N',N'-tris(3-methyl-pyridin-2-ylmethyl)ethylene-1,2-diamine.

(C) Ligands of the General Formula (IC):

(IC)

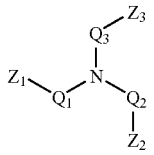

wherein $Z_1$, $Z_2$ and $Z_3$ independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

$Q_1$, $Q_2$, and $Q_3$ independently represent a group of the formula:

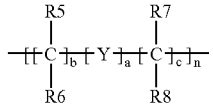

wherein $5 \geqq a+b+c \geqq 1$; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, -(G)P—, —P(O)— and -(G)N—, wherein G is selected from hydrogen, alkyl, aryl, arylalkyl, cycloalkyl, each except hydrogen being optionally substituted by one or more functional groups E; and R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I.

$Z_1$, $Z_2$ and $Z_3$ each represent a coordinating group, preferably selected from optionally substituted pyridin-2-yl, optionally substituted imidazol-2-yl, optionally substituted imidazol-4-yl, optionally substituted pyrazol-1-yl, and optionally substituted quinolin-2-yl. Preferably, $Z_1$, $Z_2$ and $Z_3$ each represent optionally substituted pyridin-2-yl.

Optional substituents for the groups $Z_1$, $Z_2$ and $Z_3$ are preferably selected from $C_{1-4}$-alkyl, aryl, arylalkyl, heteroaryl, methoxy, hydroxy, nitro, amino, carboxyl, halo, and carbonyl, preferably methyl.

Also preferred is that $Q_1$, $Q_2$ and $Q_3$ are defined such that a=b=0, c=1 or 2, and n=1.

Preferably, each $Q_1$, $Q_2$ and $Q_3$ independently represent $C_{1-4}$-alkylene, more preferably a group selected from —$CH_2$— and —$CH_2CH_2$—.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

Preferably, the ligand is selected from tris(pyridin-2-ylmethyl)amine, tris(3-methyl-pyridin-2-ylmethyl)amine, tris(5-methyl-pyridin-2-ylmethyl)amine, and tris(6-methyl-pyridin-2-ylmethyl)amine.

(D) Ligands of the General Formula (ID):

(ID)

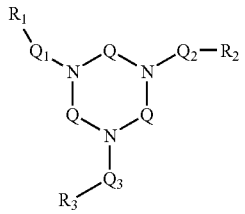

wherein $R_1$, $R_2$, and $R_3$ independently represent a group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E;

Q independently represent a group selected from $C_{2-3}$-alkylene optionally substituted by H, benzyl or $C_{1-8}$-alkyl;

$Q_1$, $Q_2$ and $Q_3$ independently represent a group of the formula:

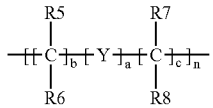

wherein $5 \geqq a+b+c \geqq 1$; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, -(G)P—, —P(O)— and -(G)N—, wherein G is selected from hydrogen, alkyl, aryl, arylalkyl, cycloalkyl, each except hydrogen being optionally substituted by one or more functional groups E; and R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with RB and/or independently R6 together with R7, represent $C_{1-6}$-alkylene optionally substituted by $C_{1-4}$-alkyl, —F, —Cl, —Br or —I, provided that at least one, preferably at least two, of $R_1$, $R_2$ and $R_3$ is a coordinating group.

At least two, and preferably at least three, of $R_1$, $R_2$ and $R_3$ independently represent a group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole. Preferably, at least two of $R_1$, $R_2$, $R_3$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

Preferably, substituents for groups $R_1$, $R_2$, $R_3$, when representing a heterocyclic or heteroaromatic ring, are selected from $C_{1-4}$-alkyl, aryl, arylalkyl, heteroaryl, methoxy, hydroxy, nitro, amino, carboxyl, halo, and carbonyl.

Preferably, $Q_1$, $Q_2$ and $Q_3$ are defined such that a=b=0, c=1, 2, 3 or 4 and n=1. Preferably, the groups $Q_1$, $Q_2$ and $Q_3$ independently represent a group selected from —$CH_2$— and —$CH_2CH_2$—.

Group Q is preferably a group selected from —$CH_2CH_2$— and —$CH_2CH_2CH_2$—.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked-together.

In a Preferred Aspect, the Ligand is of the General Formula (IID):

(IID)

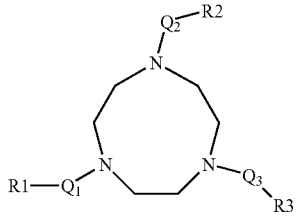

wherein R1, R2, R3 are as defined previously for $R_1$, $R_2$, $R_3$, and $Q_1$, $Q_2$, $Q_3$ are as defined previously.

Preferred classes of ligands according to this preferred aspect, as represented by formula (IID) above, are as follows:

(i) Ligands of the General Formula (IID) Wherein:

R1, R2, R3 each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

In this class, we prefer that:

R1, R2, R3 each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

(ii) Ligands of the General Formula (IID) Wherein:

two of R1, R2, R3 each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and one of R1, R2, R3 represents a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl).

In this class, we prefer that:

two of R1, R2, R3 each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and one of R1, R2, R3 represents a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^{30}$ $Me_3$.

In especially preferred embodiments, the ligand is selected from:

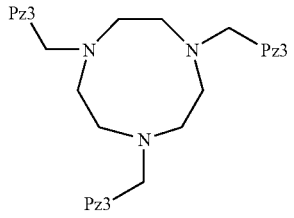

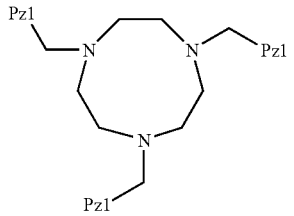

-continued

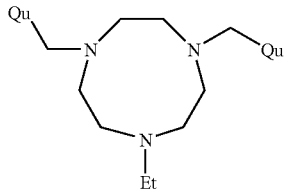

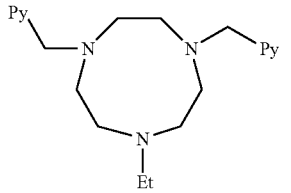

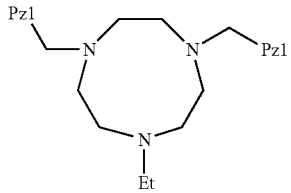

wherein -Et represents ethyl, -Py represents pyridin-2-yl, Pz3 represents pyrazol-3-yl, Pz1 represents pyrazol-1-yl, and Qu represents quinolin-2-yl.

(E) Ligands of the General Formula (IE):

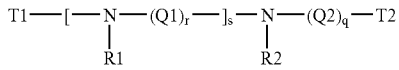

(IE)

wherein g represents zero or an integer from 1 to 6;

r represents an integer from 1 to 6;

s represents zero or an integer from 1 to 6;

Q1 and Q2 independently represent a group of the formula:

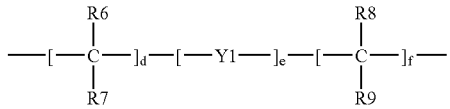

wherein

5≧d+e+f≧1; d=0–5; e=0–5; f=0–5;

each Y1 independently represents a group selected from —O—, —S—, —SO—, —$SO_2$—, —C(O)—, arylene, alkylene, heteroarylene, heterocycloalkylene, -(G)P—, —P(O)— and -(G)N—, wherein G is selected from hydrogen, alkyl, aryl, arylalkyl, cycloalkyl, each except hydrogen being optionally substituted by one or more functional groups E;

if s>1, each —[—N(R1)-(Q1)$_r$-]-group is independently defined;

R1, R2, R6, R7, R8, R9 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R6 together with R7, or R8 together with R9, or both, represent oxygen, or R6 together with R8 and/or independently R7 together with R9, or R6 together with R9 and/or independently R7 together with R8, represent $C_{1-6}$-alkylene optionally substituted by $C_{1-4}$-alkyl, —F, —Cl, —Br or —I;

or one of R1–R9 is a bridging group bound to another moiety of the same general formula;

T1 and T2 independently represent groups R4 and R5, wherein R4 and R5 are as defined for R1–R9, and if g=0 and s>0, R1 together with R4, and/or R2 together with R5, may optionally independently represent ═CH—R10, wherein R10 is as defined for R1–R9, or T1 and T2 may together (-T2-T1-) represent a covalent bond linkage when s>1 and g>0;

if T1 and T2 together represent a single bond linkage, Q1 and/or Q2 may independently represent a group of the formula: ═CH—[—Y1-]$_e$-CH═ provided R1 and/or R2 are absent, and R1 and/or R2 may be absent provided Q1 and/or Q2 independently represent a group of the formula:

═CH—[—Y1-]$_e$-CH═.

The groups R1–R9 are preferably independently selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulpho-$C_0$–$C_{20}$-alkyl and esters and salts thereof, sulphamoyl-$C_0$–$C_{20}$-alkyl, amino-$C_0$–$C_{20}$-alkyl, aryl-$C_0$–$C_{20}$-alkyl, heteroaryl-$C_0$–$C_{20}$-alkyl, $C_0$–$C_{20}$-alkyl, alkoxy-$C_0$–$C_8$-alkyl, carbonyl-$C_0$–$C_6$-alkoxy, and aryl-$C_0$–$C_6$-alkyl and $C_0$–$C_{20}$-alkylamide.

One of R1–R9 may be a bridging group which links the ligand moiety to a second ligand moiety of preferably the same general structure. In this case the bridging group is independently defined according to the formula for Q1, Q2, preferably being alkylene or hydroxy-alkylene or a heteroaryl-containing bridge, more preferably $C_{1-6}$-alkylene optionally substituted by $C_{1-4}$-alkyl, —F, —Cl, —Br or —I.

In a first variant according to formula (IE), the groups T1 and T2 together form a single bond linkage and s>1, according to general formula (IIE):

(IIE)

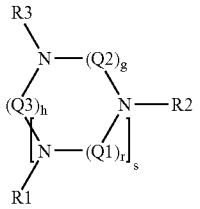

wherein R3 independently represents a group as defined for R1–R9; Q3 independently represents a group as defined for Q1, Q2; h represents zero or an integer from 1 to 6; and s=s−1.

In a first embodiment of the first variant, in general formula (IIE), s=1, 2 or 3; r=g=h=1; d=2 or 3; e=f=0; R6=R7=H, preferably such that the ligand has a general formula selected from:

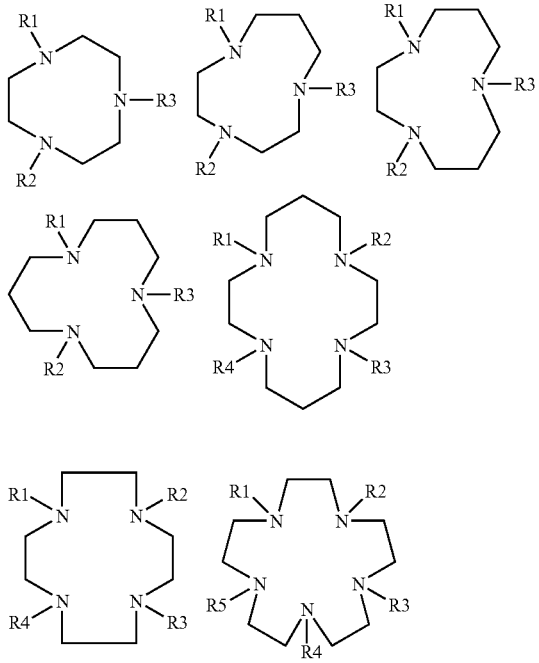

In these preferred examples, R1, R2, R3 and R4 are preferably independently selected from —H, alkyl, aryl, heteroaryl, and/or one of R1–R4 represents a bridging group bound to another moiety of the same general formula and/or two or more of R1–R4 together represent a bridging group linking N atoms in the same moiety, with the bridging group being alkylene or hydroxy-alkylene or a heteroaryl-containing bridge, preferably heteroarylene. More preferably, R1, R2, R3 and R4 are independently selected from —H, methyl, ethyl, isopropyl, nitrogen-containing heteroaryl, or a bridging group bound to another moiety of the same general formula or linking N atoms in the same moiety with the bridging group being alkylene or hydroxy-alkylene.

In a second embodiment of the first variant, in general formula (IIE), s=2 and r=g=h=1, according to the general formula:

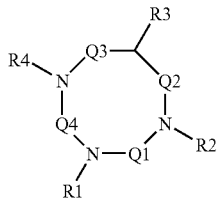

In this second embodiment, preferably R1–R4 are absent; both Q1 and Q3 represent ═CH—[—Y1-]$_e$-CH═; and both Q2 and Q4 represent —$CH_2$—[—Y1-]$_n$-$CH_2$—.

Thus, preferably the ligand has the general formula:

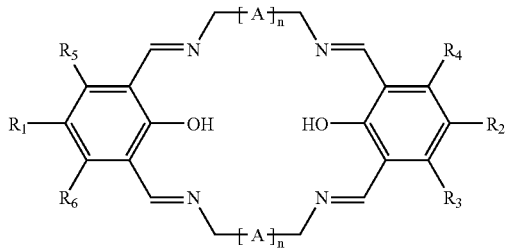

wherein A represents optionally substituted alkylene optionally interrupted by a heteroatom; and n is zero or an integer from 1 to 5.

Preferably, R1–R6 represent hydrogen, n=1 and A=—$CH_2$—, —CHOH—, —$CH_2N(R)CH_2$— or —$CH_2CH_2N(R)CH_2CH_2$— wherein R represents hydrogen or alkyl, more preferably A=—$CH_2$—, —CHOH— or —$CH_2CH_2NHCH_2CH_2$—.

In a second variant according to formula (IE), T1 and T2 independently represent groups R4, R5 as defined for R1–R9, according to the general formula (IIIE):

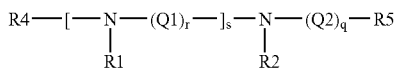

(IIIE)

In a first embodiment of the second variant, in general formula (IIIE), s=1; r=1; g=0; d=f=1; e=0–4; Y1=—$CH_2$—; and R1 together with R4, and/or R2 together with R5, independently represent ═CH—R10, wherein R10 is as defined for R1–R9. In one example, R2 together with R5 represents ═CH—R10, with R1 and R4 being two separate groups. Alternatively, both R1 together with R4, and R2 together with R5 may independently represent ═CH—R10. Thus, preferred ligands may for example have a structure selected from:

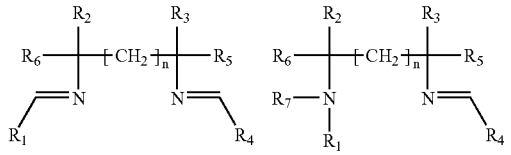

wherein n=0–4.

Preferably, the ligand is selected from:

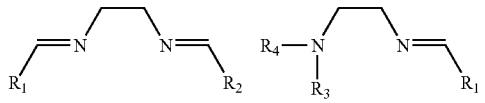

wherein R1 and R2 are selected from optionally substituted phenols, heteroaryl-$C_0$–$C_{20}$-alkyls, R3 and R4 are selected from —H, alkyl, aryl, optionally substituted phenols, heteroaryl-$C_0$–$C_{20}$-alkyls, alkylaryl, aminoalkyl, alkoxy, more preferably R1 and R2 being selected from optionally substituted phenols, heteroaryl-$C_0$–$C_2$-alkyls, R3 and R4 are selected from —H, alkyl, aryl, optionally substituted phenols, nitrogen-heteroaryl-$C_0$–$C_2$-alkyls.

In a second embodiment of the second variant, in general formula (IIIE), s=1; r=1; g=0; d=f=1; e=1–4; Y1=—C(R')(R"), wherein R' and R" are independently as defined for R1–R9. Preferably, the ligand has the general formula:

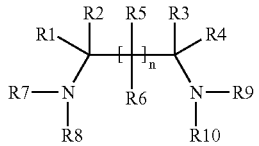

The groups R1, R2, R3, R4, R5 in this formula are preferably —H or $C_0$–$C_{20}$-alkyl, n=0 or 1, R6 is —H, alkyl, —OH or —SH, and R7, R8, R9, R10 are preferably each independently selected from —H, $C_0$–$C_{20}$-alkyl, heteroaryl-$C_0$–$C_{20}$-alkyl, alkoxy-$C_0$–$C_8$-alkyl and amino-$C_0$–$C_{20}$-alkyl.

In a third embodiment of the second variant, in general formula (IIIE), s=0; g=1; d=e=0; f=1–4. Preferably, the ligand has the general formula:

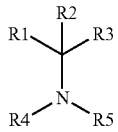

This class of ligand is particularly preferred according to the invention.

More preferably, the ligand has the general formula:

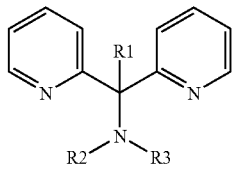

wherein R1, R2, R3 are as defined for R2, R4, R5.

In a fourth embodiment of the second variant, the ligand is a pentadentate ligand of the general formula (IVE):

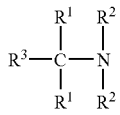

(IVE)

wherein each $R^1$, $R^2$ independently represents —$R^4$—$R^5$, $R^3$ represents hydrogen, optionally substituted alkyl, aryl or arylalkyl, or —$R^4$—$R^5$, each $R^4$ independently represents a single bond or optionally substituted alkylene, alkenylene, oxyalkyene, aminoalkylene, alkylene ether, carboxylic ester or carboxylic amide, and each $R^5$ independently represents an optionally N-substituted aminoalkyl group or an optionally substituted heteroaryl group selected from pyridinyl, pyrazinyl, pyrazolyl, pyrrolyl, imidazolyl, benzimidazolyl, pyrimidinyl, triazolyl and thiazolyl.

Ligands of the class represented by general formula (IVE) are also particularly preferred according to the invention. The ligand having the general formula (IVE), as defined above, is a pentadentate ligand. By 'pentadentate' herein is meant that five hetero atoms can coordinate to the metal M ion in the metal-complex.

In formula (IVE), one coordinating hetero atom is provided by the nitrogen atom in the methylamine backbone, and preferably one coordinating hetero atom is contained in each of the four $R^1$ and $R^2$ side groups. Preferably, all the coordinating hetero atoms are nitrogen atoms.

The ligand of formula (IVE) preferably comprises at least two substituted or unsubstituted heteroaryl groups in the four side groups. The heteroaryl group is preferably a pyridin-2-yl group and, if substituted, preferably a methyl- or ethyl-substituted pyridin-2-yl group. More preferably, the heteroaryl group is an unsubstituted pyridin-2-yl group. Preferably, the heteroaryl group is linked to methylamine, and preferably to the N atom thereof, via a methylene group. Preferably, the ligand of formula (IVE) contains at least one optionally substituted amino-alkyl side group, more preferably two amino-ethyl side groups, in particular 2-(N-alkyl) amino-ethyl or 2-(N,N-dialkyl)amino-ethyl.

Thus, in formula (IVE) preferably $R^1$ represents pyridin-2-yl or $R^2$ represents pyridin-2-yl-methyl. Preferably $R^2$ or $R^1$ represents 2-amino-ethyl, 2-(N-(m)ethyl)amino-ethyl or 2-(N,N-di(m)ethyl)amino-ethyl. If substituted, $R^5$ preferably represents 3-methylpyridin-2-yl. $R^3$ preferably represents hydrogen, benzyl or methyl.

Examples of preferred ligands of formula (IVE) in their simplest forms are:

(i) pyridin-2-yl containing ligands such as:

N,N-bis(pyridin-2-yl-methyl)-bis(pyridin-2-yl)methylamine;

N,N-bis(pyrazol-1-yl-methyl)-bis(pyridin-2-yl)methylamine;

N,N-bis(imidazol-2-yl-methyl)-bis(pyridin-2-yl)methylamine;

N,N-bis(1,2,4-triazol-1-yl-methyl)-bis(pyridin-2-yl)methylamine;

N,N-bis(pyridin-2-yl-methyl)-bis(pyrazol-1-yl)methylamine;

N,N-bis(pyridin-2-yl-methyl)-bis(imidazol-2-yl)methylamine;

N,N-bis(pyridin-2-yl-methyl)-bis(1,2,4-triazol-1-yl)methylamine;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-2-phenyl-1-aminoethane;

N,N-bis(pyrazol-1-yl-methyl)-1,1-bis(pyridin-2-yl)-1-aminoethane;

N,N-bis(pyrazol-1-yl-methyl)-1,1-bis(pyridin-2-yl)-2-phenyl-1-aminoethane;

N,N-bis(imidazol-2-yl-methyl)-1,1-bis(pyridin-2-yl)-1-aminoethane;

N,N-bis(imidazol-2-yl-methyl)-1,1-bis(pyridin-2-yl)-2-phenyl-1-aminoethane;

N,N-bis(1,2,4-triazol-1-yl-methyl)-1,1-bis(pyridin-2-yl)-1-aminoethane;

N,N-bis(1,2,4-triazol-1-yl-methyl)-1,1-bis(pyridin-2-yl)-2-phenyl-1-aminoethane;

N,N-bis(pyridin-2-yl-methyl)-1,1-bis(pyrazol-1-yl)-1-aminoethane;

N,N-bis(pyridin-2-yl-methyl)-1,1-bis(pyrazol-1-yl)-2-phenyl-1-aminoethane;

N,N-bis(pyridin-2-yl-methyl)-1,1-bis(imidazol-2-yl)-1-aminoethane;

N,N-bis(pyridin-2-yl-methyl)-1,1-bis(imidazol-2-yl)-2-phenyl-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-1-aminohexane;

N,N-bis(pyridin-2-yl-methyl)-1,1-bis(pyridin-2-yl)-2-phenyl-1-aminoethane;

N,N-bis(pyridin-2-yl-methyl)-1,1-bis(pyridin-2-yl)-2-(4-sulphonic acid-phenyl)-1-aminoethane;

N,N-bis(pyridin-2-yl-methyl)-1,1-bis(pyridin-2-yl)-2-(pyridin-2-yl)-1-aminoethane;

N,N-bis(pyridin-2-yl-methyl)-1,1-bis(pyridin-2-yl)-2-(pyridin-3-yl)-1-aminoethane;

N,N-bis(pyridin-2-yl-methyl)-1,1-bis(pyridin-2-yl)-2-(pyridin-4-yl)-1-aminoethane;

N,N-bis(pyridin-2-yl-methyl)-1,1-bis(pyridin-2-yl)-2-(1-alkyl-pyridinium-4-yl)-1-aminoethane;

N,N-bis(pyridin-2-yl-methyl)-1,1-bis(pyridin-2-yl)-2-(1-alkyl-pyridinium-3-yl)-1-aminoethane;

N,N-bis(pyridin-2-yl-methyl)-1,1-bis(pyridin-2-yl)-2-(1-alkyl-pyridinium-2-yl)-1-aminoethane;

(ii) 2-amino-ethyl containing ligands such as:

N,N-bis(2-(N-alkyl)amino-ethyl)-bis(pyridin-2-yl)methylamine;

N,N-bis(2-(N-alkyl)amino-ethyl)-bis(pyrazol-1-yl)methylamine;

N,N-bis(2-(N-alkyl)amino-ethyl)-bis(imidazol-2-yl)methylamine;

N,N-bis(2-(N-alkyl)amino-ethyl)-bis(1,2,4-triazol-1-yl) methylamine;

N,N-bis(2-(N,N-dialkyl)amino-ethyl)-bis(pyridin-2-yl) methylamine;

N,N-bis(2-(N,N-dialkyl)amino-ethyl)-bis(pyrazol-1-yl) methylamine;

N,N-bis(2-(N,N-dialkyl)amino-ethyl)-bis(imidazol-2-yl) methylamine;

N,N-bis(2-(N,N-dialkyl)amino-ethyl)-bis(1,2,4-triazol-1-yl)methylamine;

N,N-bis(pyridin-2-yl-methyl)-bis(2-amino-ethyl)methylamine;

N,N-bis(pyrazol-1-yl-methyl)-bis(2-amino-ethyl)methylamine;

N,N-bis(imidazol-2-yl-methyl)-bis(2-amino-ethyl)methylamine;

N,N-bis(1,2,4-triazol-1-yl-methyl)-bis(2-amino-ethyl) methylamine.

More preferred ligands are:

N,N-bis(pyridin-2-yl-methyl)-bis(pyridin-2-yl)methylamine, hereafter referred to as N4Py.

N,N-bis(pyridin-2-yl-methyl)-1,1-bis(pyridin-2-yl)-1-aminoethane, hereafter referred to as MeN4Py, N,N-bis(pyridin-2-yl-methyl)-1,1-bis(pyridin-2-yl)-2-phenyl-1-aminoethane, hereafter referred to as BzN4Py.

In a fifth embodiment of the second variant, the ligand represents a pentadentate or hexadentate ligand of general formula (VE):

$$R^1R^1N—W—NR^1R^2 \quad (VE)$$

wherein each $R^1$ independently represents —$R^3$—V, in which $R^3$ represents optionally substituted alkylene, alkenylene, oxyalkylene, aminoalkylene or alkylene ether, and V represents an optionally substituted heteroaryl group selected from pyridinyl, pyrazinyl, pyrazolyl, pyrrolyl, imidazolyl, benzimidazolyl, pyrimidinyl, triazolyl and thiazolyl;

W represents an optionally substituted alkylene bridging group selected from —$CH_2CH_2$—, —$CH_2CH_2CH_2$—, —$CH_2CH_2CH_2CH_2$—, —$CH_2$—$C_6H_4$—$CH_2$—, —$CH_2$—$C_6H_{10}$—$CH_2$—, and —$CH_2$—$C_{10}H_6$—$CH_2$—; and $R^2$ represents a group selected from $R^1$, and alkyl, aryl and arylalkyl groups optionally substituted with a substituent selected from hydroxy, alkoxy, phenoxy, carboxylate, carboxamide, carboxylic ester, sulphonate, amine, alkylamine and $N^+(R^4)_3$, wherein $R^4$ is selected from hydrogen, alkanyl, alkenyl, arylalkanyl, arylalkenyl, oxyalkanyl, oxyalkenyl, aminoalkanyl, aminoalkenyl, alkanyl ether and alkenyl ether.

The ligand having the general formula (VE), as defined above, is a pentadentate ligand or, if $R^1$=$R^2$, can be a hexadentate ligand. As mentioned above, by 'pentadentate' is meant that five hetero atoms can coordinate to the metal M ion in the metal-complex. Similarly, by 'hexadentate' is meant that six hetero atoms can in principle coordinate to the metal M ion. However, in this case it is believed that one of the arms will not be bound in the complex, so that the hexadentate ligand will be penta coordinating.

In the formula (VE), two hetero atoms are linked by the bridging group W and one coordinating hetero atom is contained in each of the three $R^1$ groups. Preferably, the coordinating hetero atoms are nitrogen atoms.

The ligand of formula (VE) comprises at least one optionally substituted heteroaryl group in each of the three $R^1$ groups. Preferably, the heteroaryl group is a pyridin-2-yl group, in particular a methyl- or ethyl-substituted pyridin-2-yl group. The heteroaryl group is linked to an N atom in formula (VE), preferably via an alkylene group, more preferably a methylene group. Most preferably, the heteroaryl group is a 3-methyl-pyridin-2-yl group linked to an N atom via methylene.

The group $R^2$ in formula (VE) is a substituted or unsubstituted alkyl, aryl or arylalkyl group, or a group $R^1$. However, preferably $R^2$ is different from each of the groups $R^1$ in the formula above. Preferably, $R^2$ is methyl, ethyl, benzyl, 2-hydroxyethyl or 2-methoxyethyl. More preferably, $R^2$ is methyl or ethyl.

The bridging group W may be a substituted or unsubstituted alkylene group selected from —$CH_2CH_2$—, —$CH_2CH_2CH_2$—, —$CH_2CH_2CH$—$_2CH_2$—, —$CH_2$—$C_6H_4$—$CH_2$—, —$CH_2$—$C_6H_{10}$—$CH_2$—, and —$CH_2$—$C_{10}H_6$—$CH_2$— (wherein —$C_6H_4$—, —$C_6H_{10}$—, —$C_{10}H_6$— can be ortho-, para-, or meta-$C_6H_4$—, —$C_6H_{10}$—, —$C_{10}H_6$—). Preferably, the bridging group W is an ethylene or 1,4-butylene group, more preferably an ethylene group.

Preferably, V represents substituted pyridin-2-yl, especially methyl-substituted or ethyl-substituted pyridin-2-yl, and most preferably V represents 3-methylpyridin-2-yl.

(F) Ligands of the Classes Disclosed in WO-A-98/39098 and WO-A-98/39406.

The counter ions Y in formula (A1) balance the charge z on the complex formed by the ligand L, metal M and coordinating species X. Thus, if the charge z is positive, Y may be an anion such as $RCOO^-$, $BPh_4^-$, $ClO_4^-$, $BF_4^-$, $PF_6^-$, $RSO_3^-$, $RSO_4^-$, $SO_4^{2-}$, $NO_3^-$, $F^-$, $Cl^-$, $Br^-$, or $I^-$, with R being hydrogen, optionally substituted alkyl or optionally substituted aryl. If z is negative, Y may be a common cation such as an alkali metal, alkaline earth metal or (alkyl) ammonium cation.

Suitable counter ions Y include those which give rise to the formation of storage-stable solids. Preferred counter ions for the preferred metal complexes are selected from $R^7COO^-$, $ClO_4^-$, $BF_4^-$, $PF_6^-$, $RSO_3^-$ (in particular $CF_3SO_3^-$), $RSO_4^-$, $SO_4^{2-}$, $NO_3^-$, $F^-$, $Cl^-$, $Br^-$, and $I^-$, wherein R represents hydrogen or optionally substituted phenyl, naphthyl or $C_1$–$C_4$ alkyl.

It will be appreciated that the complex (A1) can be formed by any appropriate means, including in situ formation whereby precursors of the complex are transformed into the active complex of general formula (A1) under conditions of storage or use. Preferably, the complex is formed as a well-defined complex or in a solvent mixture comprising a salt of the metal M and the ligand L or ligand L-generating species. Alternatively, the catalyst may be formed in situ from suitable precursors for the complex, for example in a solution or dispersion containing the precursor materials. In one such example, the active catalyst may be formed in situ in a mixture comprising a salt of the metal M and the ligand L, or a ligand L-generating species, in a suitable solvent. Thus, for example, if M is iron, an iron salt such as $FeSO_4$ can be mixed in solution with the ligand L, or a ligand L-generating species, to form the active complex. Thus, for example, the composition may formed from a mixture of the ligand L and a metal salt $MX_n$ in which preferably n=1–5, more preferably 1–3. In another such example, the ligand L, or a ligand L-generating species, can be mixed with metal M ions present in the substrate or wash liquor to form the active catalyst in situ. Suitable ligand L-generating species include metal-free compounds or metal coordination complexes that comprise the ligand L and can be substituted by metal M ions to form the active complex according the formula (A1).

Throughout the description and claims generic groups have been used, for example alkyl, alkoxy, aryl. Unless otherwise specified the following are preferred group restrictions that may be applied to generic groups found within compounds disclosed herein:

alkyl: $C_1$–$C_6$-alkyl, alkenyl: C2–C6-alkenyl, cycloalkyl: C3–C8-cycloalkyl, alkoxy: C1–C6-alkoxy, alkylene: selected from the group consisting of: methylene; 1,1-ethylene; 1,2-ethylene; 1,1-propylene; 1,2-propylene; 1,3-propylene; 2,2-propylene; butan-2-ol-1,4-diyl; propan-2-ol-1,3-diyl; and 1,4-butylene, aryl: selected from homoaromatic compounds having a molecular weight under 300, arylene: selected from the group consisting of: 1,2-benzene; 1,3-benzene; 1,4-benzene; 1,2-naphthalene; 1,3-naphthalene; 1,4-naphthalene; 2,3-naphthalene; phenol-2,3-diyl; phenol-2,4-diyl; phenol-2,5-diyl; and phenol-2,-6-diyl, heteroaryl: selected from the group consisting of: pyridinyl; pyrimidinyl; pyrazinyl; triazolyl, pyridazinyl; 1,3,5-triazinyl; quinolinyl; isoquinolinyl; quinoxalinyl; imidazolyl; pyrazolyl; benzimidazolyl; thiazolyl; oxazolidinyl; pyrrolyl; carbazolyl; indolyl; and isoindolyl, heteroarylene: selected from the group consisting of: pyridin-2,3-diyl; pyridin-2,4-diyl; pyridin-2,5-diyl; pyridin-2,6-diyl; pyridin-3,4-diyl; pyridin-3,5-diyl; quinolin-2,3-diyl; quinolin-2,4-diyl; quinolin-2,8-diyl; isoquinolin-1,3-diyl; isoquinolin-1,4-diyl; pyrazol-1,3-diyl; pyrazol-3,5-diyl; triazole-3,5-diyl; triazole-1,3-diyl; pyrazin-2,5-diyl; and imidazole-2,4-diyl, heterocycloalkyl: selected from the group consisting of: pyrrolinyl; pyrrolidinyl; morpholinyl; piperidinyl; piperazinyl; hexamethylene imine; and oxazolidinyl, amine: the group —$N(R)_2$ wherein each R is independently selected from: hydrogen; C1–C6-alkyl; C1–C6-alkyl-C6H5; and phenyl, wherein when both R are C1–C6-alkyl both R together may form an —NC3 to an —NC5 heterocyclic ring with any remaining alkyl chain forming an alkyl substituent to the heterocyclic ring, halogen: selected from the group consisting of: F; Cl; Br and I, sulphonate: the group —$S(O)_2OR$, wherein R is selected from: hydrogen; C1–C6-alkyl; phenyl; C1–C6-alkyl-C6H5; Li; Na; K; Cs; Mg; and Ca, sulphate: the group —$OS(O)_2OR$, wherein R is selected from: hydrogen; C1–C6-alkyl; phenyl; C1–C6-alkyl-C6H5; Li; Na; K; Cs; Mg; and Ca, sulphone: the group —$S(O)_2R$, wherein R is selected from: hydrogen; C1–C6-alkyl; phenyl; C1–C6-alkyl-C6H5 and amine (to give sulphonamide) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring, carboxylate derivative: the group —C(O)OR, wherein R is selected from: hydrogen, C1–C6-alkyl; phenyl; C1–C6-alkyl-C6H5, Li; Na; K; Cs; Mg; and Ca, carbonyl derivative: the group —C(O)R, wherein R is selected from: hydrogen; C1–C6-alkyl; phenyl; C1–C6-alkyl-C6H5 and amine (to give amide) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring, phosphonate: the group —$P(O)(OR)_2$, wherein each R is independently selected from: hydrogen; C1–C6-alkyl; phenyl; C1–C6-alkyl-C6H5; Li; Na; K; Cs; Mg; and Ca, phosphate: the group —$OP(O)(OR)_2$, wherein each R is independently selected from: hydrogen; C1–C6-alkyl; phenyl; C1–C6-alkyl-C6H5; Li; Na; K; Cs; Mg; and Ca, phosphine: the group —$P(R)_2$, wherein each R is independently selected from: hydrogen; C1–C6-alkyl; phenyl; and C1–C6-alkyl-C6H5, phosphine oxide: the group —$P(O)R_2$, wherein R is independently selected from: hydrogen; C1–C6-alkyl; phenyl; and C1–C6-alkyl-C6H5; and amine (to give phosphonamidate) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring.

Unless otherwise specified the following are more preferred group restrictions that may be applied to groups found within compounds disclosed herein:

alkyl: C1–C4-alkyl, alkenyl: C3–C6-alkenyl, cycloalkyl: C6–C8-cycloalkyl, alkoxy: C1–C4-alkoxy, alkylene: selected from the group consisting of: methylene; 1,2-ethylene; 1,3-propylene; butan-2-ol-1,4-diyl; and 1,4-butylene, aryl: selected from group consisting of: phenyl; biphenyl, naphthalenyl; anthracenyl; and phenanthrenyl, arylene: selected from the group consisting of: 1,2-benzene, 1,3-benzene, 1,4-benzene, 1,2-naphthalene, 1,4-naphthalene, 2,3-naphthalene and phenol-2,6-diyl, heteroaryl: selected from the group consisting of: pyridinyl; pyrimidinyl; quinolinyl; pyrazolyl; triazolyl; isoquinolinyl; imidazolyl; and oxazolidinyl, heteroarylene: selected from the group consisting of: pyridin-2,3-diyl; pyridin-2,4-diyl; pyridin-2,6-diyl; pyridin-3,5-diyl; quinolin-2,3-diyl; quinolin-2,4-diyl; isoquinolin-1,3-diyl; isoquinolin-1,4-diyl; pyrazol-3,5-diyl; and imidazole-2,4-diyl, heterocycloalkyl: selected from the group consisting of: pyrrolidinyl; morpholinyl; piperidinyl; and piperazinyl, amine: the group —$N(R)_2$, wherein each R is independently selected from: hydrogen; C1–C6-alkyl; and benzyl, halogen: selected from the group consisting of: F and Cl, sulphonate: the group —$S(O)_2OR$, wherein R is selected from: hydrogen; C1–C6-alkyl; Na; K; Mg; and Ca, sulphate: the group —$OS(O)_2OR$, wherein R is selected from: hydrogen; C1–C6-alkyl; Na; K; Mg; and Ca, sulphone: the group —$S(O)_2R$, wherein R is selected from: hydrogen; C1–C6-alkyl; benzyl and amine selected from the group: —NR'2, wherein each R' is independently selected from: hydrogen; C1–C6-alkyl; and benzyl, carboxylate derivative: the group —C(O)OR, wherein R is selected from hydrogen; Na; K; Mg; Ca; C1–C6-alkyl; and benzyl, carbonyl derivative: the group: —C(O)R, wherein R is selected from: hydrogen; C1–C6-alkyl; benzyl and amine selected from the group: —NR'2, wherein each R' is independently selected from: hydrogen; C1–C6-alkyl; and benzyl, phosphonate: the group —$P(O)(OR)_2$, wherein each R is independently selected from: hydrogen; C1–C6-alkyl, benzyl; Na; K; Mg; and Ca, phosphate: the group —$OP(O)(OR)_2$, wherein each R is independently selected from: hydrogen; C1–C6-alkyl; benzyl; Na; K; Mg; and Ca, phosphine: the group —$P(R)_2$, wherein each R is independently selected from: hydrogen; C1–C6-alkyl; and benzyl, phosphine oxide: the group —$P(O)R_2$, wherein R is independently selected from: hydrogen; C1–C6-alkyl; benzyl and amine selected from the group: —NR'2, wherein each R' is independently selected from: hydrogen; C1–C6-alkyl; and benzyl.

In typical washing compositions the level of the organic substance is such that the in-use level is from 0.05 μM to 50 mM, with preferred in-use levels for domestic laundry operations falling in the range 1 to 100 μM. Higher levels may be desired and applied in industrial textile bleaching processes.

Preferably, the aqueous medium has a pH in the range from pH 6 to 13, more preferably from pH 6 to 11, still more preferably from pH 8 to 11, and most preferably from pH 8 to 10, in particular from pH 9 to 10.

The method of the present invention has particular application in detergent bleaching, especially for laundry cleaning. Accordingly, in another preferred embodiment, the method uses the organic substance in a liquor that additionally contains a surface-active material, optionally together with detergency builder.

The bleach liquor may for example contain a surface-active material in an amount of from 10 to 50% by weight. The surface-active material may be naturally derived, such as soap, or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch.

Typical synthetic anionic surface-actives are usually water-soluble alkali metal salts of organic sulphates and sulphonates having alkyl groups containing from about 8 to about 22 carbon atoms, the term "alkyl" being used to include the alkyl portion of higher aryl groups. Examples of suitable synthetic anionic detergent compounds are sodium and ammonium alkyl sulphates, especially those obtained by sulphating higher ($C_8$–$C_{18}$) alcohols produced, for example, from tallow or coconut oil; sodium and ammonium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil fatty acid monoglyceride sulphates and sulphonates; sodium and ammonium salts of sulphuric acid esters of higher ($C_9$–$C_{18}$) fatty alcohol alkylene oxide, particularly ethylene oxide, reaction products; the reaction products of fatty acids such as coconut fatty acids esterified with isethionic acid and neutralised with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins With $SO_2$ and $Cl_2$ and then hydrolysing with a base to produce a random sulphonate; sodium and ammonium ($C_7$–$C_{12}$) dialkyl sulphosuccinates; and olefin sulphonates, which term is used to describe material made by reacting olefins, particularly ($C_{10}$–$C_{20}$) alpha-olefins, with $SO_3$ and then neutralising and hydrolysing the reaction product. The preferred anionic detergent compounds are sodium ($C_{10}$–$C_{15}$) alkylbenzene sulphonates, and sodium ($C_{16}$–$C_{18}$) alkyl ether sulphates.

Examples of suitable nonionic surface-active compounds which may be used, preferably together with the anionic surface-active compounds, include, in particular, the reaction products of alkylene oxides, usually ethylene oxide, with alkyl ($C_6$–$C_{22}$) phenols, generally 5–25 EO, i.e. 5–25 units of ethylene oxides per molecule; and the condensation products of aliphatic ($C_8$–$C_{18}$) primary or secondary linear or branched alcohols with ethylene oxide, generally 2–30 EO. Other so-called nonionic surface-actives include alkyl polyglycosides, sugar esters, long-chain tertiary amine oxides, long-chain tertiary phosphine oxides and dialkyl sulphoxides.

Amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

The detergent bleach liquor will preferably comprise from 1 to 15% wt of anionic surfactant and from 10 to 40% by weight of nonionic surfactant. In a further preferred embodiment, the detergent active system is free from $C_{16}$–$C_{12}$ fatty acid soaps.

The bleach liquor may also contains a detergency builder, for example in an amount of from about 5 to 80% by weight, preferably from about 10 to 60% by weight.

Builder materials may be selected from 1) calcium sequestrant materials, 2) precipitating materials, 3) calcium ion-exchange materials and 4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetal carboxylates as disclosed in U.S. Pat. No. 4,144,226 and U.S. Pat. No. 4,146,495.

Examples of precipitating builder materials include sodium orthophosphate and sodium carbonate.

Examples of calcium ion-exchange builder materials include the various types of water-insoluble crystalline or amorphous aluminosilicates, of which zeolites are the best known representatives, e.g. zeolite A, zeolite B (also known as zeolite P), zeolite C, zeolite X, zeolite Y and also the zeolite P-type as described in EP-A-0,384,070.

In particular, the bleach liquor may contain any one of the organic and inorganic builder materials, though, for environmental reasons, phosphate builders are preferably omitted or only used in very small amounts. Typical builders usable in the present invention are, for example, sodium carbonate, calcite/carbonate, the sodium salt of nitrilotriacetic acid, sodium citrate, carboxymethyloxy malonate, carboxymethyloxy succinate and water-insoluble crystalline or amorphous aluminosilicate builder materials, each of which can be used as the main builder, either alone or in admixture with minor amounts of other builders or polymers as co-builder.

It is preferred that the composition contains not more than 5% by weight of a carbonate builder, expressed as sodium carbonate, more preferably not more than 2.5% by weight to substantially nil, if the composition pH lies in the lower alkaline region of up to 10.

Apart from the components already mentioned, the bleach liquor can contain any of the conventional additives in amounts of which such materials are normally employed in fabric washing detergent compositions. Examples of these additives include buffers such as carbonates, lather boosters, such as alkanolamides, particularly the monoethanol amides derived from palmkernel fatty acids and coconut fatty acids; lather depressants, such as alkyl phosphates and silicones; anti-redeposition agents, such as sodium carboxymethyl cellulose and alkyl or substituted alkyl cellulose ethers; stabilisers, such as phosphonic acid derivatives (i.e. Dequest® types); fabric softening agents; inorganic salts and alkaline buffering agents, such as sodium sulphate and sodium silicate; and, usually in very small amounts, fluorescent agents; perfumes; enzymes, such as proteases, cellulases, lipases, amylases and oxidases; germicides and colourants.

Transition metal sequestrants such as EDTA, and phosphonic acid derivatives such as EDTMP (ethylene diamine tetra(methylene phosphonate)) may also be included, in addition to the organic substance specified, for example to improve the stability sensitive ingredients such as enzymes, fluorescent agents and perfumes, but provided the composition remains bleaching effective. However, the treatment composition containing the organic substance, is preferably substantially, and more preferably completely, devoid of transition metal sequestrants (other than the organic substance).

EXPERIMENTAL

Synthesis of the Complex [(MeN4Py)FeCl]Cl (Compound 1)

MeN4py (=1,1-bis(pyridin-2yl)-N,N-bis(pyridin-2ymethyl)aminoethane) was synthesised as described in EP 0 909 809.

The MeN4Py ligand (33.7 g; 88.5 mmoles) was dissolved in 500 ml dry methanol. Small portions of $FeCl_2.4H_2O$ (0.95 eq; 16.7 g; 84.0 mmoles) were added, yielding a clear red solution. After addition, the solution was stirred for 30 minutes at room temperature, after which the methanol was removed (rotary-evaporator). The dry solid was ground and 150 ml of ethylacetate was added and the mixture was stirred until a fine red powder was obtained. This powder was washed twice with ethyl acetate, dried in the air and further dried under vacuum (40° C.). El. Anal. Calc. for [Fe(MeN4py)Cl]Cl.$2H_2O$: C, 53.03; H, 5.16; N, 12.89; Cl, 13.07; Fe, 10.01%. Found C, 52.29/52.03; H, 5.05/5.03; N, 12.55/12.61; Cl: 12.73/12.69; Fe: 10.06/10.01%.

In an aqueous solution containing 10 mM carbonate buffer (pH 10) containing 8 mM hydrogen peroxide, tomato-soy oil stained cloths were added and kept in contact with the solution under agitation for 15 minutes at 30° C. Subsequently, catalase enzyme was added (200 U/ml; Bovine Liver catalase, ex Sigma, C9322) and the wash liquor was stirred for another 15 min. This experiment was done in the presence of 0, 0.5, 1, 2 and 5 μM of compound 1. In comparative experiments, the same experiments were done by avoiding the addition of catalase (so during the whole experiment hydrogen peroxide was present) (COMP A in tables below). In the second series of comparitive experiments no hydrogen peroxide was added (so only air) (COMP B in table below).

After the wash, the cloths were rinsed with water and subsequently dried at 30° C. and the change in colour was measured immediately after drying with a Linotype-Hell scanner (ex Linotype). The change in colour (including bleaching) is expressed as the ΔE value. The measured colour difference (ΔE) between the washed cloth and the unwashed cloth is defined as follows:

$$\Delta E=[(\Delta L)^2+(\Delta a)^2+(\Delta b)^2]^{1/2}$$

wherein ΔL is a measure for the difference in darkness between the washed and unwashed test cloth; Δa and Δb are measures for the difference in redness and yellowness respectively between both cloths. With regard to this colour measurement technique, reference is made to Commission International de l'Eclairage (CIE); Recommendation on Uniform Colour Spaces, colour difference equations, psychometric colour terms, supplement no 2 to CIE Publication, no 15, Colormetry, Bureau Central de la CIE, Paris 1978. The results are shown below in the table below.

TABLE 1

| | Results on tomato oil stains | | |
|---|---|---|---|
| | H2O2 for 15 min, then air for 15 min | COMP A: H2O2 for 30 min | COMP B No H2O2 |
| Blank (0 μM 1) | 2.8 | 2.3 | 2.3 |
| 0.5 μM 1 | 3.6 | 2.6 | 3.0 |
| 1 μM 1 | 6.0 | 3.8 | 4.4 |
| 2 μM 1 | 7.8 | 5.2 | 5.7 |
| 5 μM 1 | 10.5 | 8.3 | 10.4 |

The results shown in the table reveal that upon having a combination of hydrogen peroxide and air, a better bleaching result the tomato stain is obtained as compared to using either hydrogen peroxide alone or air alone.

The invention claimed is:

1. A method of bleaching a substrate in an aqueous solution during a wash which comprises the steps of:

providing a concentration of a peroxyl species in the aqueous solution for bleaching tea type stains optionally with a transition metal catalyst that further activates hydrogen peroxide;

providing an amount of oxygen bleaching catalyst to the wash together with oxygen dissolved in the aqueous solution;

reducing the concentration of peroxyl species in the aqueous solution for increasing the amount of oxygen bleaching catalyst available for oxygen bleaching in the wash.

2. A method of bleaching a substrate in an aqueous solution according to claim 1, wherein in the aqueous medium the [(oxygen species-complex]/[peroxyl species-complex] is between 10 and 0.1 at a point in time during the wash.

3. A method of bleaching a substrate in an aqueous solution according to claim 1, wherein in the aqueous medium the [$O_2$]/[total peroxyl present] is in the range 10 and 0.1 at a point in time during the wash.

4. A method of bleaching a substrate in an aqueous solution according to claim 1, wherein that wash is at a temperature of between 10° C. and 45° C.

* * * * *